United States Patent [19]

Pickett

[11] 4,214,411

[45] Jul. 29, 1980

[54] PANEL AND JOINT SYSTEM AND TRANSPARENT ACOUSTIC BARRIERS EMPLOYING SAME

[75] Inventor: William H. Pickett, Framingham, Mass.

[73] Assignee: The Fanwall Corporation, Framingham, Mass.

[21] Appl. No.: 869,621

[22] Filed: Jan. 16, 1978

[51] Int. Cl.[2] ..... E04B 1/82

[52] U.S. Cl. ..... 52/144; 52/222; 52/774; 181/210

[58] Field of Search ..... 52/144, 222, 495; 181/210; 256/13.1

[56] References Cited

U.S. PATENT DOCUMENTS

| | | | |
|---|---|---|---|
| 2,827,138 | 3/1958 | Roy | 52/222 X |
| 3,206,898 | 9/1965 | Schroyer | 52/222 X |
| 3,313,075 | 4/1967 | Buchmeier | 52/222 X |
| 3,327,444 | 6/1967 | Downing | 52/144 X |
| 3,513,613 | 5/1970 | Jones et al. | 52/222 |
| 3,783,968 | 1/1974 | Derry | 256/13.1 X |
| 3,909,994 | 10/1975 | Richter | 52/222 X |
| 4,035,968 | 7/1977 | Caspar et al. | 52/222 |

*Primary Examiner*—J. Karl Bell

[57] ABSTRACT

Panels have tensioning formations at their edges that are engaged upon support members via resilient compressive loadbearing elements. In the constructions shown the tensioning formations comprise integral, semicylindrical edge portions of the panels and the load-bearing elements comprise mating resilient rods inserted into the semicylindrical formations. The panels are relatively thin extrusions of transparent polycarbonate resin forming an acoustical barrier structure. Thermal expansion and contraction is accommodated by mutual action of the panels and the resilient load-bearing elements. A transparent acoustical barrier wall along a highway and a noise barrier canopy over a rapid transit line are shown.

16 Claims, 12 Drawing Figures

FIG 3
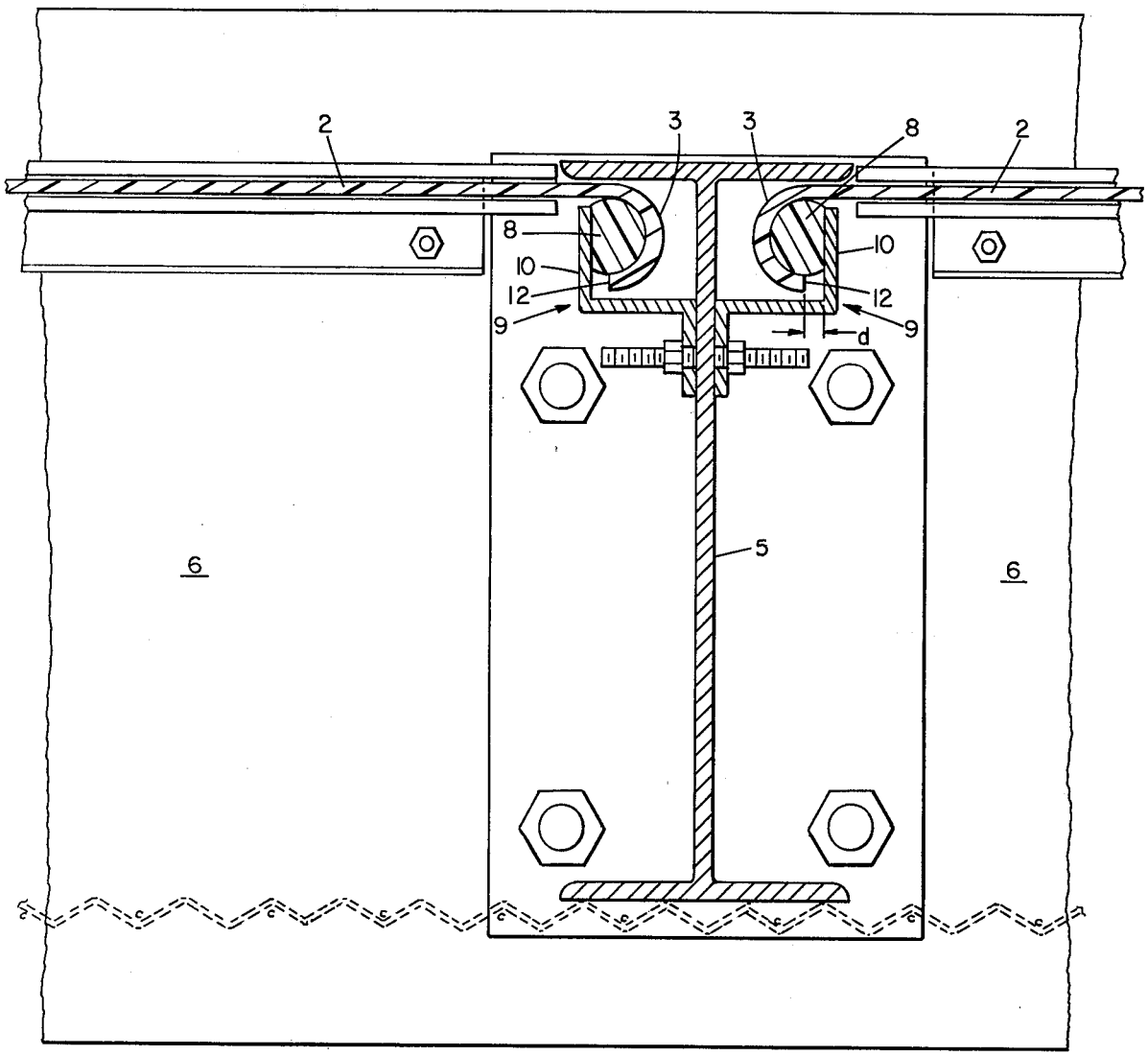
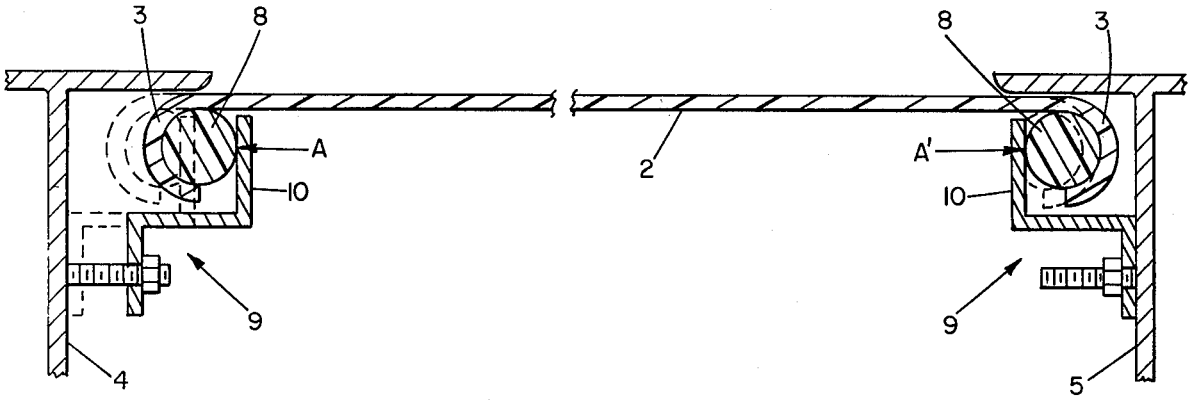
FIG 3a

FIG 5
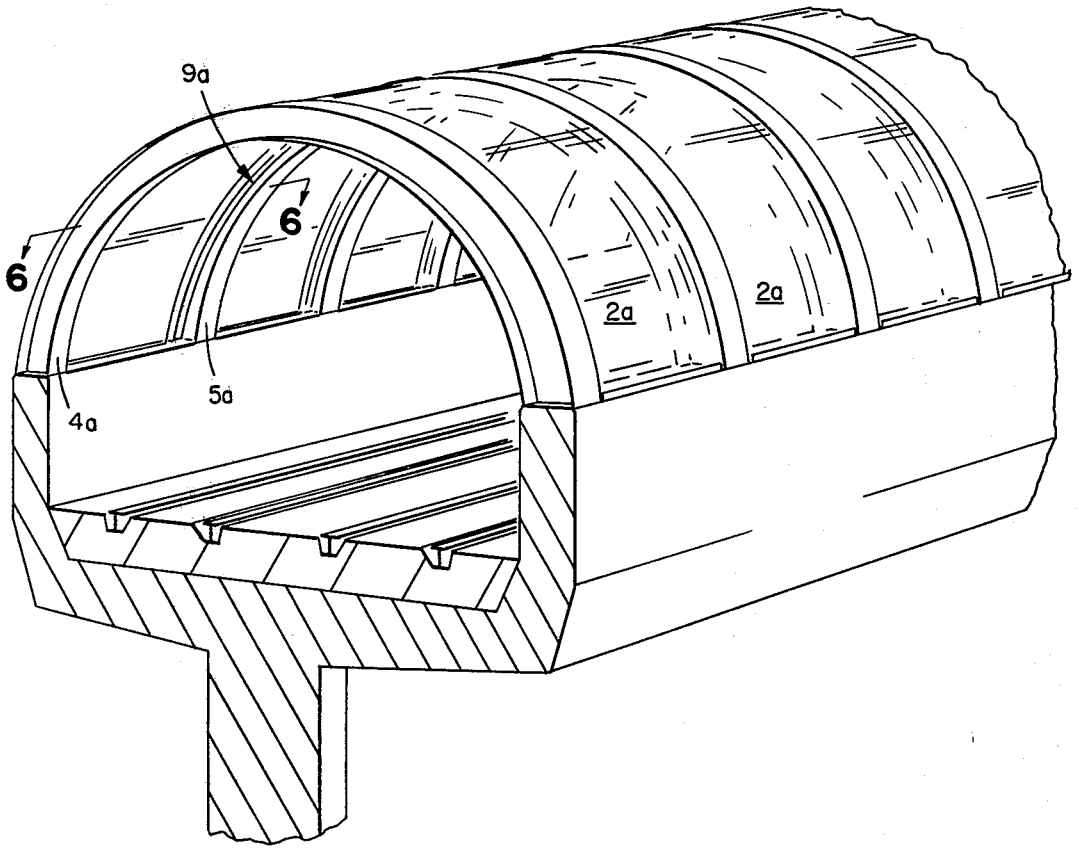
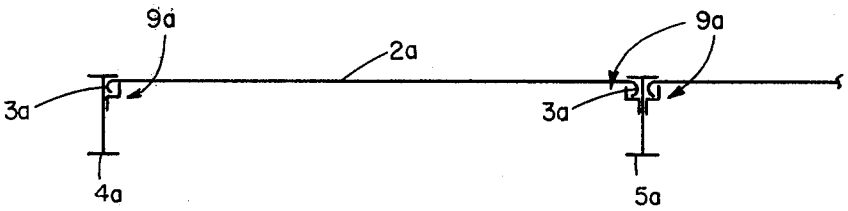
FIG 6

PANEL AND JOINT SYSTEM AND TRANSPARENT ACOUSTIC BARRIERS EMPLOYING SAME

BACKGROUND OF THE INVENTION

This invention relates to transparent acoustic barriers for use along highways, railroads and the like and to panel and joint assemblies useful in such barriers as well as in other constructions.

The need for acoustic barriers in urban environments to control highway, railway and rapid transit noise is well recognized. Barriers for this purpose of opaque construction are often objectionable because they block the view of travelers and in some instances are objectionable to residents of the affected urban area as well. Large sheets of transparent material such as safety glasses and synthetic resins, e.g., high strength polycarbonates, are in principle available for use in such impact-damage-prone barriers. However, not only is the cost of such materials great, but also the known systems for joining such panels to supporting structure raise numerous problems. For instance, it is difficult to secure the panels against hurricane force winds or other force conditions.

The support problems for panels for acoustic barriers as well as other applications is made worse for panels of synthetic materials due to the significant differences in the thermal expansion properties of synthetic panel materials and their metal supports. Channel supports that are constructed to accommodate panel movement during thermal expansion and contraction of the panel tend to increase the risk of withdrawal of the panels from their supports when the panels bow under wind or other loading. To stiffen the panels against bowing by increasing their thickness adds detrimentally to the cost of the panels. Similarly, to increase the size and complexity of the supports adds detrimentally to the cost. For reasons such as these, the use of synthetic panels has been limited.

A principal object of the invention is to overcome the various problems described.

SUMMARY OF THE INVENTION

According to the present invention, the various problems are overcome by a unique panel and joint system which takes advantage of the high tensile strength of the panel materials. The invention reduces the costly panel thickness and at the same time offers a secure structure capable of withstanding extreme force conditions. All of this can readily be achieved in an acoustically tight manner.

According to one feature of the invention, portions of a panel at opposite sides of a span are provided with opposed tensioning formations. These formations are engaged upon resilient compressive load-bearing elements in the manner that the tensioning formations are pressed apart, to place the panel material spanning the distance between the formations under tension and the load-bearing resilient elements under compression. Advantageously, all of the components, i.e., the tensioning formations, the mating resilient load-bearing elements and the support surface upon which they bear, are of elongated, coextensive form and extend along the full length of opposed edges of the panel. Thus the full extent of the panel is placed under a uniform prestressed condition, while a uniform acoustically-tight seal is obtained.

Expansion and contraction of a panel can then be accommodated with the above structure in the following manner. The prestressed condition of the panel is preferably established at the time of installation at a level to maintain prestress tension forces over the entire design temperature range of the system. Thus when the temperature rises and the panel expands and lengthens, the tensile stress is relieved to some extent, and the compressive distortion of the load-bearing element is to a degree lessened, but tensile stress in the panel and compressive engagement by it with the load-bearing element remains and the parts continue tightly together. On the other hand, under cold conditions, high wind or other loading of the panel, panel tensile stress rises and the load-bearing element is further resiliently distorted as it resists the contraction of the panel; these effects provide an even tighter union between the panels and their supports under such rigorous conditions.

In preferred embodiments, exposed portions of the panel formations are positioned to engage the supports directly when a predetermined level of stress is reached. This leads to a second phase of load transfer which permits the full strength properties of the panel to be efficiently utilized while protecting the resilient load-bearing and sealing element from undue compression.

These and numerous other features and advantages of the invention will be understood from the following description of a preferred embodiment.

THE DRAWINGS

Figure 1:
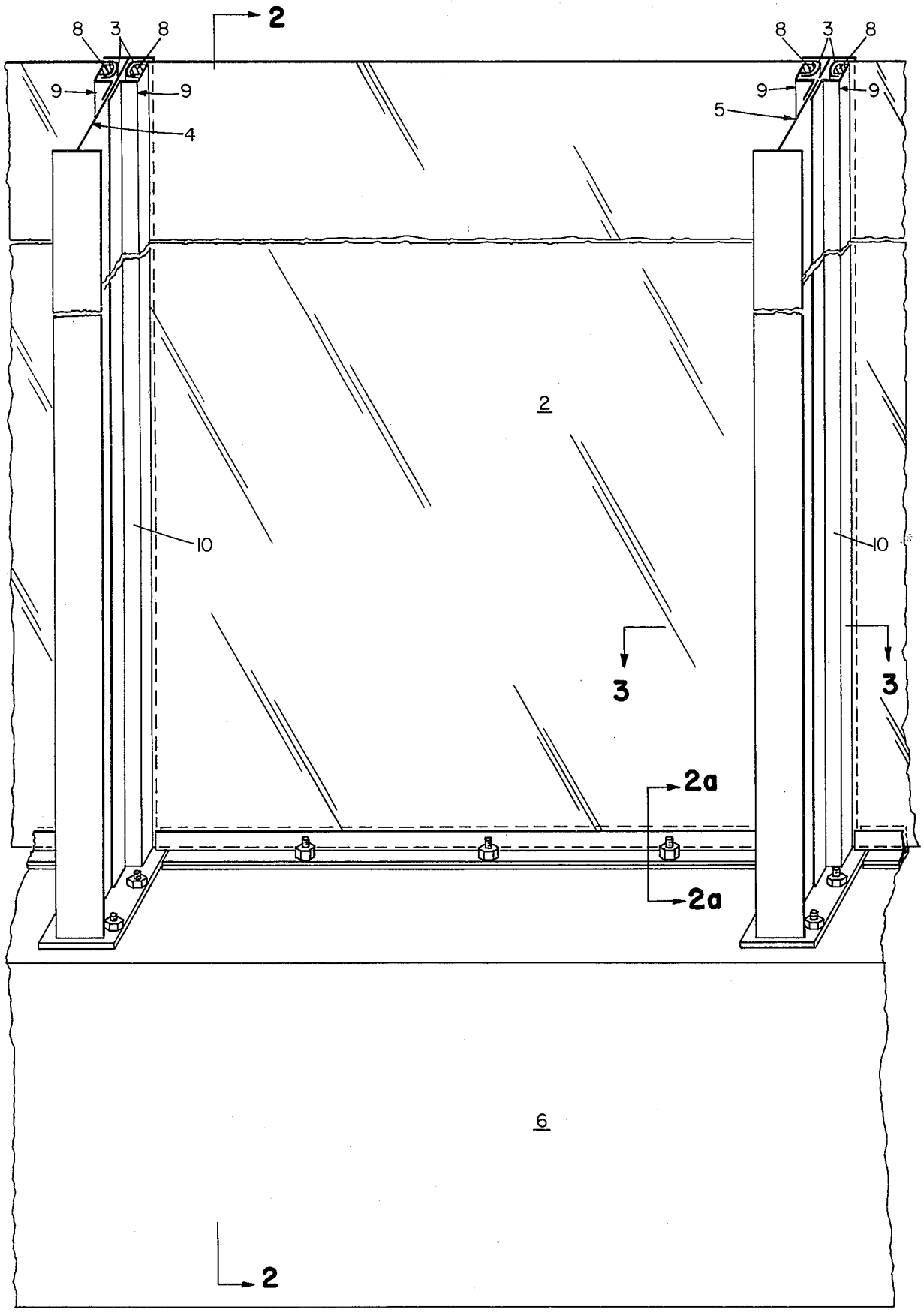
FIG. 1 is an elevational view of a transparent highway noise barrier.
Figure 7:
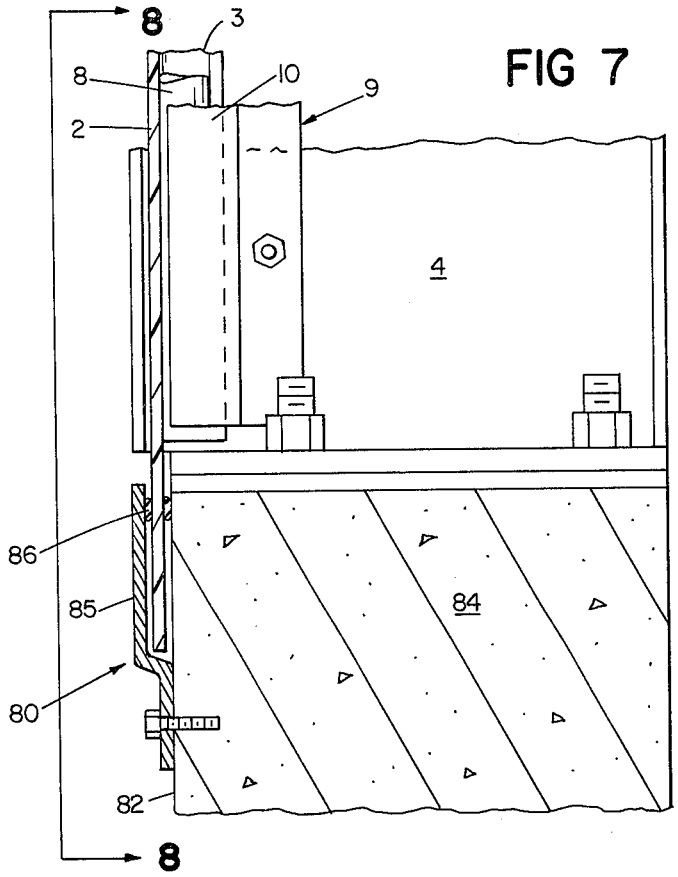
Figure 8:
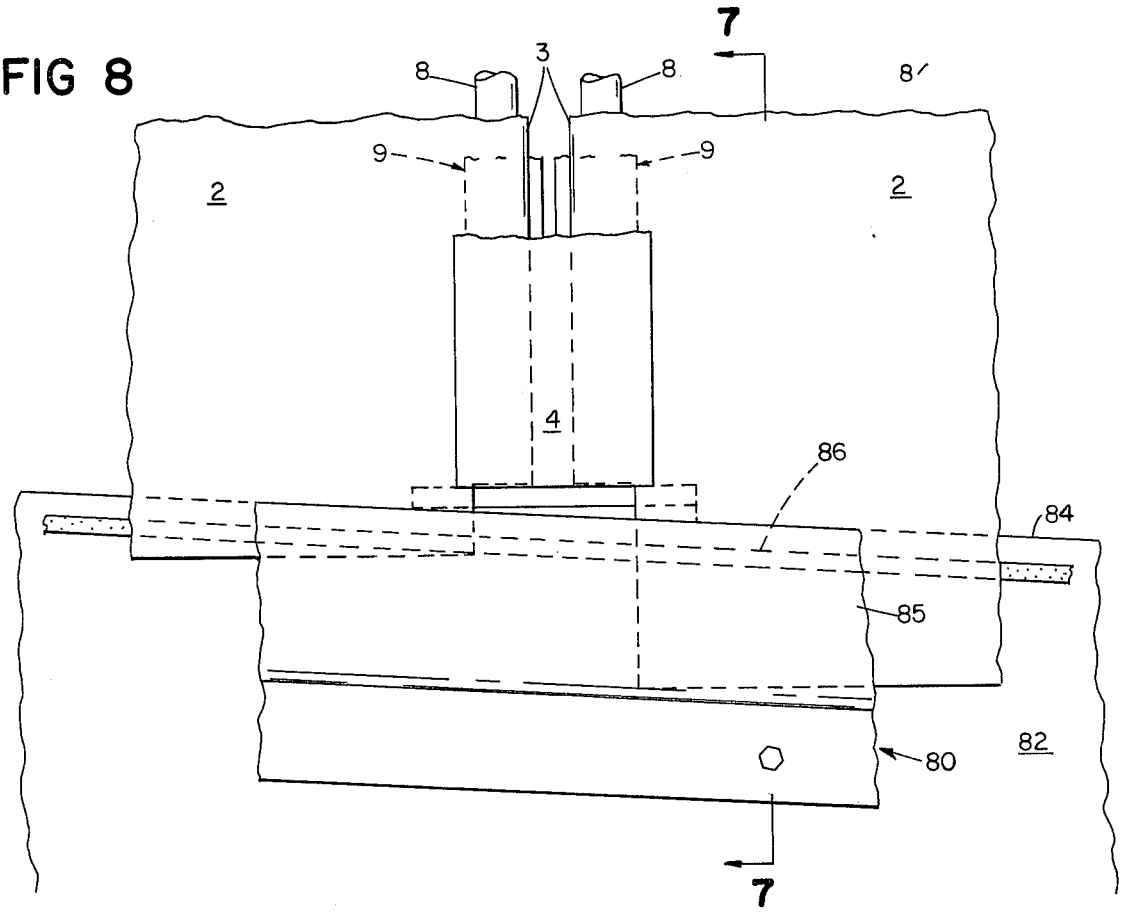

FIG. 3 is a horizontal cross-sectional view taken on line 3—3 of FIG. 1 on an enlarged scale showing important features of the joint system while FIG. *3a* is a view similar to FIG. 3 illustrating conditions during assembly FIGS. *4a*, *4b*, and *4c* are diagrammatic views similar to FIG. 3 illustrating reaction of the noise barrier panel and joint system to varying load and temperature conditions;

FIG. 5 is a perspective view of a rapid transit sound barrier canopy according to the invention while FIG. 6 is a cross-sectional view taken on lines 6—6 of FIG. 5 of the panel and joint system;

FIG. 7 is a vertical cross-sectional view of a further embodiment of a vertical noise barrier while FIG. 8 is an elevational view thereof taken on line 8—8 of FIG. 7.

DESCRIPTION OF PREFERRED EMBODIMENT

Figure 2:
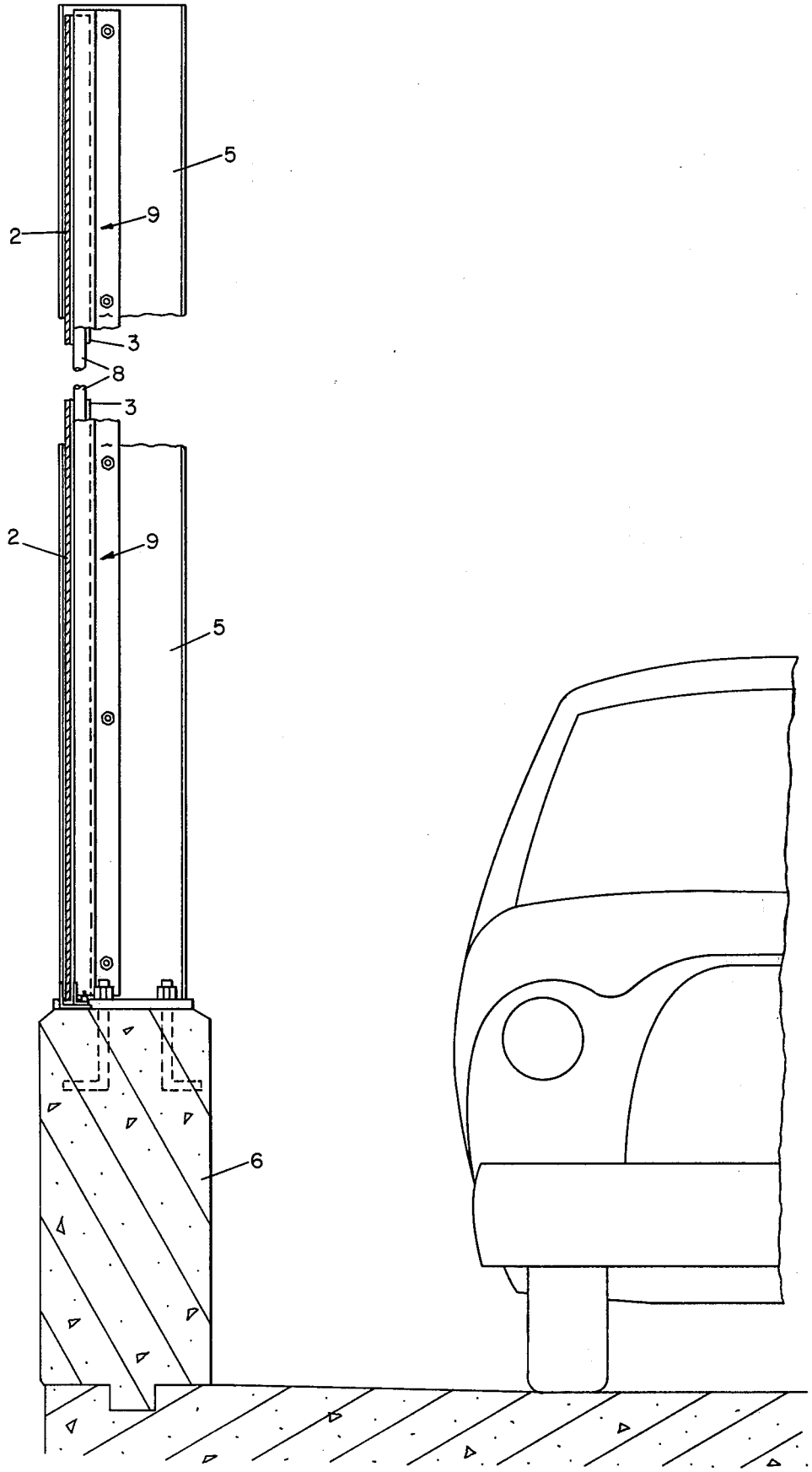
FIG. 2 is a vertical cross-sectional view of the barrier of FIG. 1 taken on line 2—2 while FIG. *2a* is a partial, perspective view on an enlarged scale taken on line *2a*—*2a* of FIG. 1.

Referring now to FIGS. 1 through 3, a wide span panel 2 of high strength transparent resinous material extends between supports 4 and 5. As shown, supports 4 and 5 comprise columnar beams rising from a concrete roadside barrier 6, and the panels 2 extend between the beams to comprise a transparent acoustic barrier to protect the surrounding neighborhood from the noise of road traffic.

As shown most clearly in FIGS. 3 and *3a*, the upright edges of the panel 2 provide integral, curved semicylindrical tensioning formations 3. Each of these vertically extending formations engages a correspondingly elongated, resilient load-bearing element 8 which bears against retaining flange 10 of vertical elongated bracket 9 carried by the supports 4, 5. The vertical edge formation 3, the panel 2, the load-bearing resilient element 8 and the retaining flange 10 all extend for the full height of the panel, along each of its vertical edges. In the preferred embodiment, the transparent sound barrier panel 2 is constructed of high impact strength polycarbonate resin, e.g., polycarbonate marketed by the General Electric Company under the trademark "Lexan". The load-bearing resilient element 8 is preferably a rod-form cylindrical element of closed cell polyurethane foam or a silicone rubber material such as is used between panels in building construction. The panel in the particular embodiment has a ¼" thickness, the distance between supports is 8 feet, the barrier is 10 feet high and the edge formations are of ½ inch radius curvature, formed integrally with the panel by extrusion through a die slot or rollers of corresponding form. Post-forming of flat thermoplastic panels is also possible. The panel has a coefficient of thermal expansion of $3.75\times10^{-5}$ in/in/° F. (more than 300% of that of aluminum and more than 600% of that of steel), an ultimate strength of 9,500 p.s.i. and a modulus of elasticity of 345,000 p.s.i.

Figure 4A:
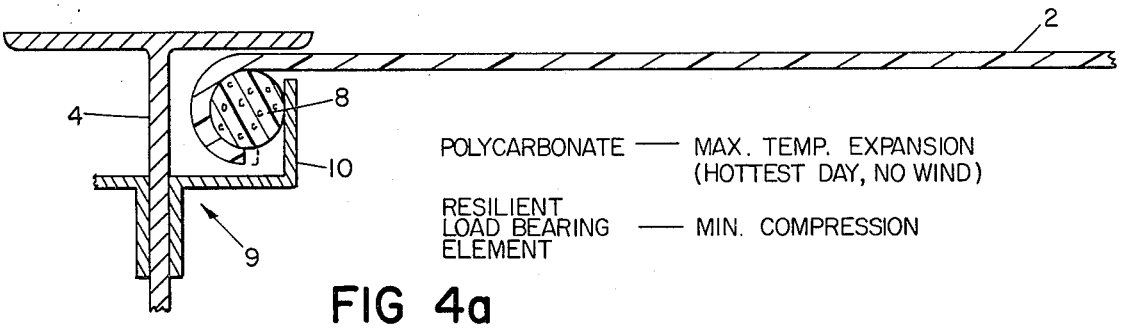
Figure 4B:
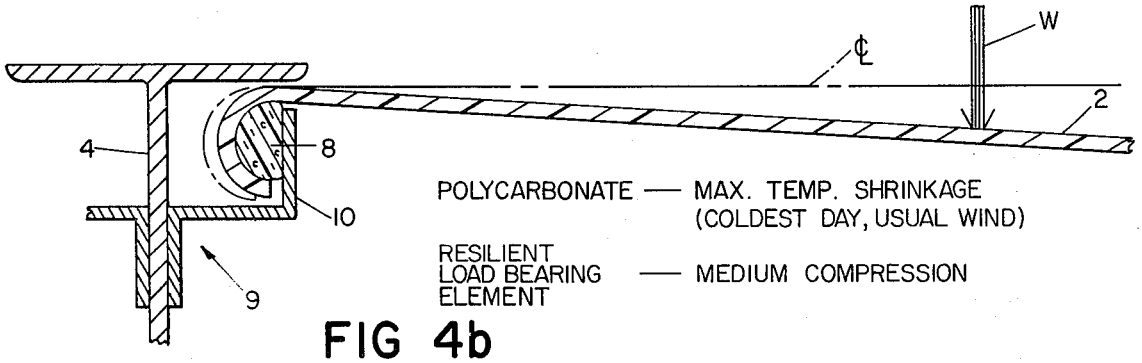
Figure 4C:
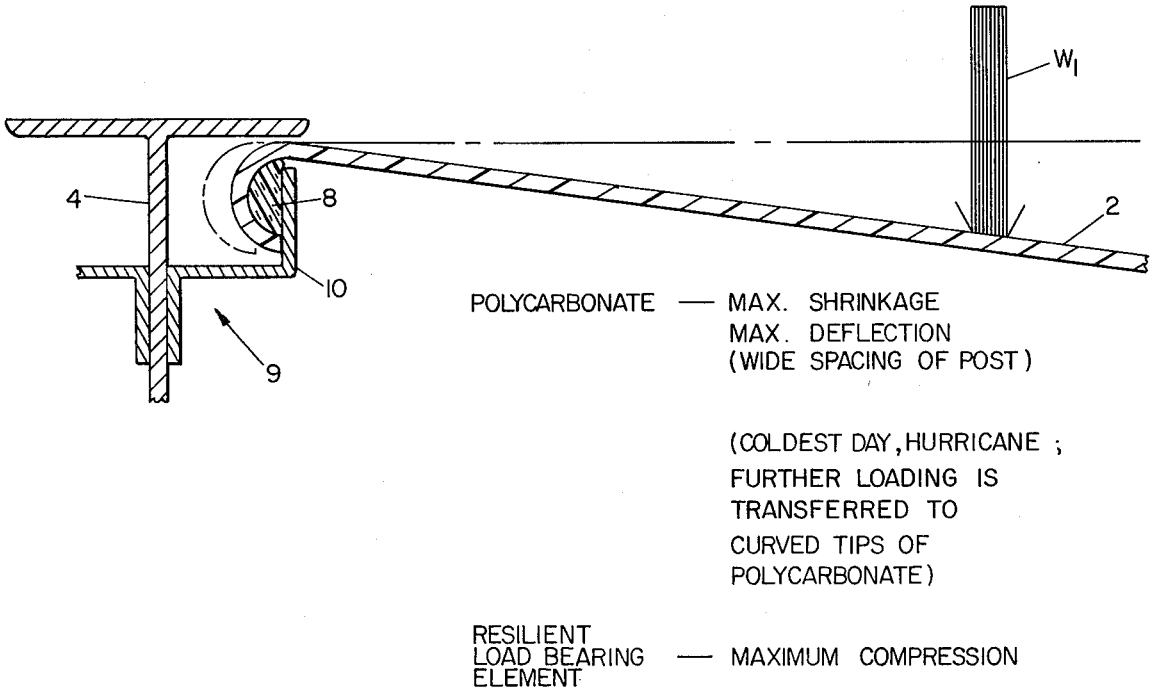

The semicylindrical tensioning formation 3 and the compression load-bearing element 8 are cooperatively dimensioned to position the end 12 of the panel tensioning formation at a spaced distance from the load transfer face of bracket flange 10 in the normal installed condition. In this installed condition, the semicircular tensioning formation compresses the cylindrical load-bearing element 8 to a predetermined degree, as shown in FIGS. 3 and 3*a*. For installation, the transparent panel 2 is brought in position and the load-bearing element is inserted (or it is assembled in a predetermined relationship, i.e., bonded by adhesive in the hollow arc of the tensioning formation 3, or upon the flange 10 of the bracket). As the bracket is drawn tightly against the support 4, as shown in FIG. 3*a*, the flange 10 exerts pressure in the direction of the arrows A against the resilient load-bearing element 8, and via this element, upon the tensioning formation 3. The panels 2 is thus placed under tensional stress, the stress increasing until the bracket 9 is tightly seated against the support as shown in FIGS. 3 and 3*a*. Under this installed condition, it will be seen that the resilient load-bearing elements 8 are deformed under compressional stress while the transparent panel 2 is under tensional stress. Referring to FIG. 4*a*, in the condition of a very warm day, the polycarbonate substance of panel 2 expands due to the relatively high coefficient of thermal expansion of the material. This increases the effective length of the span of panel 2 and thus relieves the compressional pressure upon the load-bearing elements 8, allowing it to assume a less distorted form, as shown in FIG. 4*a*. Even under the maximum expansion condition, as depicted in 4*a*, load-bearing element 8 remains somewhat distorted under compression, effective to maintain stress in the panel, to take up variations in dimensions within manufacturing tolerances, and to seal all of the parts tightly together to prevent passage of sound. Referring to FIG. 4*b*, the condition of the coldest day is illustrated, with usual winds, in which the contraction of the panel 2 coupled with deflection due to the wind, depicted by arrow W, produces an effective shortening of the length of the span of the panel. These combined effects apply significant added tension to the panel, additional compressional loading upon the resilient elements 8, and greater bearing force upon the flange 10 of the bracket 9. Resilient elements 8 are distorted more, as shown. FIG. 4*c* represents the maximum stress position in which, due to heavy wind loading $W_1$, the resilient load-bearing element is even further compressed. The movement is so great that the tip 12 of the semicylindrical load transfer formation 3 bears directly upon the flange 10 and transfers a large increment of the total stress directly from panel to supporting bracket 9, bypassing the resilient element 8.

Figure 2A:
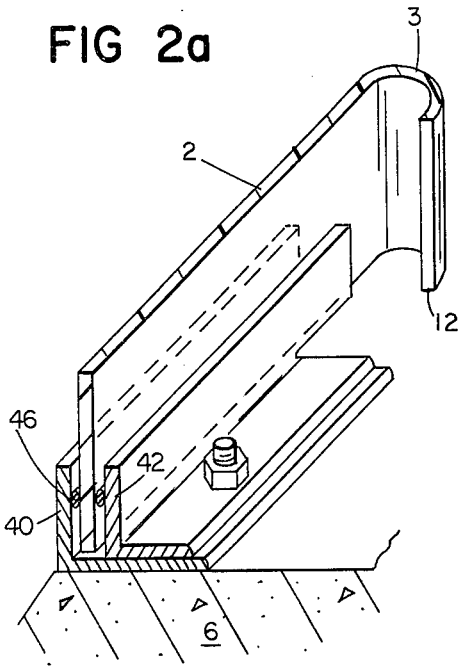

For holding the foot of the panel 2 in place and for obtaining an acoustic seal here as well, a pair of interfitted angle irons 40, 42, FIG. 2*a*, extend along the bottom of the panel. These confine the bottom margin of the panel, with seal element 46 perfecting the acoustic seal.

It will be realized that throughout all phases of wind loading and of permitted three dimensional expansion and contraction of the polycarbonate panel, the panel is securely held in position and is restrained from being forced from its holdings even under extreme wind conditions, while advantage is taken of its strength properties. Thus the panel can have relatively small thickness and therefore be economical to produce. At the same time all of this performance is achieved with a tight joint, preventing the passage of sound around the edges.

While the preferred embodiment has illustrated use of the joint system and panels when mounted between upright supports, other orientations are of course possible. In one such example, the panels just as is shown in FIGS. 1 through 4, are all similarly secured at their upper and lower edges by semicylindrical load transfer formations extending horizontally along those edges and engaging similarly extending resilient, elongted load-bearing elements and flanges.

In FIGS. 5 and 6 the same type of construction is shown in an arcuate form, suitable to achieve a transparent canopy for a rapid transit system, to protect the neighborhood from the noise of the system. In this case the tensioning formations 3*a* and the mating brackets 9*a* and the supports 4*a* and 5*a* are of corresponding arcuate form and apply tension horizontally to the semicylindrical (barrel-shape) panels 2*a*.

In FIGS. 7 and 8 a gutter type support is employed for the bottom edge of the panels. This is useful for instance in the case of mounting the acoustic barrier on curved supports, for instance on a curved bridge span. In this case the gutterform bracket 80 is secured to the side 82 of the bridge parapet or other support structure 84 which may slope relative to horizontal, as shown. Vertical supports 4 are spaced at modular distances between which the panels are installed as previously described. Despite the angle between the bottom of the bracket 80 and the bottom edge of the panel, an overlapping seal is obtained between the panel 2 and the flange 85 of the bracket by the presence of resilient sealing strips 86.

In other embodiments the tensioning formation may have other forms and the panel joint system may be used for other purposes, e.g., to replace glazed units.

Numerous variations in the specific details of the invention will be obvious to those skilled in the art.

What is claimed is:

1. An outdoor panel system suitable for use as an acoustic barrier along rights of way and bridges, comprising:

a supporting frame which includes a pair of widely spaced-apart posts having a first coefficient of thermal expansion affecting the spacing between posts, an extended panel of generally rigid material having a coefficient of thermal expansion substantially greater than that of said frame, said panel sized to span the distance between said posts, the margins of said panel subject to movement relative to the posts, back and forth in the direction of extent of the panel, due to thermal expansion and contraction, face portions of said panel exposed to variable wind loadings that tend to produce bowing of said panel with corresponding tendency to draw the edges of the panel toward each other, and a joint means between the panel and the posts, capable of secure retention of the panel despite extreme variations in temperature and wind loading relative to normal values, while permitting the panel to be of economical thickness, said joint means including, at each edge of the panel corresponding to a post, a load transfer formation of rigid material joined to and extending along the edge of the panel, and protruding to the side of the panel, a corresponding opposed post surface disposed inwardly along said panel and spaced normally from said load transfer formation, and a corresponding elastomeric, resilient loadbearing element disposed between said panel transfer formation and said post surface, said elastomeric and resilient load bearing element having an uncompressed thickness substantially greater than the normal space between said panel load bearing formation and said post surface, whereby at normal condition said elastomeric element is disposed under compression and transfers stress between said post surface and said panel load bearing formation, placing the panel under tension, said elastomeric load bearing element thereby serving as a spring element, enabling said panel edges to draw toward each other with further compression of said elastomeric element and enabling said panel edges to move apart with attendant expansion of said elastomeric element, while in each case maintaining continued pressure contact between said elastomeric element and said load bearing formation.

2. The panel system of claim 1 including a portion of said panel disposed to directly engage a support surface of a said post following a first phase of loading during which said load-bearing element is compressed a predetermined amount beyond normal compressional stress, thereby to provide a second phase of loading in which stress is additionally transferred from said panel to said post

3. The panel system of claim 1 wherein said panel consists of polycarbonate material.

4. The panel system of claim 1 wherein said resilient load-bearing element comprises polyurethane foam.

5. The panel system of claim 1 wherein said, posts are upright.

6. The panel system of claim 1 wherein said panel load-transfer said resilient compession .load-bearing element and said cooperative post surface are elongated and coextensive, extending along respective edges of the panel.

7. The panel system of claim 1 wherein said load transfer formations comprise integral formations of the respective edges of the panel.

8. The panel system of claim 1 wherein said load transfer formations are semicylindrical in form.

9. The panel system of claim 8 wherein said resilient load-bearing elements are of cylindrical rod-form inserted in the concave portion of hollow semicylindrical load transfer formations of said panel.

10. The outdoor panel system of claim 2 wherein said portion of said panel for second phase loading comprises an outer part of a said load transfer formation of the panel.

11. The outdoor panel system of claim 1 forming a durable, transparent acoustical barrier, said panel comprised of rigid transparent synthetic resinous material having high tensile strength and having a thickness of the order of ¼ inch.

12. The outdoor panel system of claim 1 wherein said joint means includes a post having an elongated flange extending to the side of an elongated web, an elongated Z bar parallel to said flange having its base leg attached to the web, said panel extending beneath said flange surface and above said outer leg, into the space defined between said web and said Z bar, and an integral formation of the edge of said panel turned downwardly from said flange, in opposed relation to the inner surface of the outer leg of the Z bar, to define said load bearing element, said resilient load bearing element disposed therebetween.

13. The panel system of claim 1 in which there are a pair of said posts which are straight and parallel to each other, said load transfer formations, said elongated resilient load bearing elements, and said opposed post surfaces all being straight and parallel to said posts, and said panel being unrestrained from thermal contraction and expansion in the direction parallel to the axes of said posts.

14. The outdoor panel system of claim 13 wherein said panel comprises a planer optically transparent plate.

15. The acoustical barrier of claim 11 in the form of a wall, said posts extending generally vertically and said panels being of planar form.

16. The acoustical barrier of claim 11 in the form of a canopy, said posts being of parallel curved form and said panel being of corresponding curvature.

* * * * *

UNITED STATES PATENT AND TRADEMARK OFFICE

CERTIFICATE OF CORRECTION

PATENT NO. : 4,214,411

DATED : July 29, 1980

INVENTOR(S) : William H. Pickett

It is certified that error appears in the above-identified patent and that said Letters Patent are hereby corrected as shown below:

Column 3, Line 57 "elements" should be --element--.

Column 4, Line 36 "elongted" should be --elongated--.

Claim 1, Column 5, Line 31 after "said panel" insert --load--.

Claim 2, Column 5, Line 59 after "post" insert --without passing through said resilient element.--.

Claim 6, Column 6, Line 8 after "load-transfer" insert --formations--.

Claim 14, Column 6, Line 51 "planer" should be --planar--.

Signed and Sealed this

Ninth Day of December 1980

[SEAL]

*Attest:*

SIDNEY A. DIAMOND

*Attesting Officer*

*Commissioner of Patents and Trademarks*